US005412914A

United States Patent [19]

Daw et al.

[11] Patent Number: 5,412,914

[45] Date of Patent: May 9, 1995

[54] RAISED ACCESS FLOORING SYSTEM

[76] Inventors: Terry L. Daw, 785 Woodshire Ave., Murray, Utah 84017; Kevin D. Moss, 1023 E. Deborah Dr., Bountiful, Utah 84010

[21] Appl. No.: 910,638

[22] Filed: Jul. 7, 1992

Related U.S. Application Data

[63] Continuation-in-part of Ser. No. 726,988, Jul. 8, 1991, abandoned.

[51] Int. Cl.[6] ..... E04B 5/00

[52] U.S. Cl. ..... 52/126.6; 52/126.7; 52/263; 52/220.2; 52/506.06; 52/648.1; 52/650.3

[58] Field of Search ..... 52/126.5–126.7, 52/263, 283, 220.1, 220.2, 506.06, 648.1, 650.3, 677, 220.3, 220.8

[56] References Cited

U.S. PATENT DOCUMENTS

| | | | |
|---|---|---|---|
| 2,140,283 | 12/1938 | Faber | 72/71 |
| 3,279,134 | 10/1966 | Donovan | 52/126 |
| 3,415,027 | 12/1968 | Snyder et al. | 52/263 |
| 3,421,280 | 1/1969 | Attwood et al. | 52/650.3 |
| 3,443,348 | 5/1969 | Papayoti | 52/299 |
| 3,705,473 | 12/1972 | Yeffal-Rueda | 52/650 |
| 4,067,156 | 1/1978 | Downing | 52/126.6 |
| 4,319,520 | 3/1982 | Lanting et al. | 52/815 X |
| 4,637,181 | 1/1987 | Cohen | 52/126.5 |
| 4,679,372 | 7/1987 | Noble | 52/648 |
| 4,745,715 | 5/1988 | Hardwick et al. | 52/126.6 |
| 4,825,603 | 5/1989 | Hardwicke et al. | 52/126.6 |
| 4,912,903 | 4/1990 | Mogami et al. | 52/648 |
| 4,942,708 | 7/1990 | Krumholz et al. | 52/263 |
| 5,052,157 | 10/1991 | Ducroux et al. | 52/126.6 |

FOREIGN PATENT DOCUMENTS

| | | | |
|---|---|---|---|
| 1017522 | 9/1977 | Canada | 20/17 |
| 2521198 | 8/1983 | France | 52/650.3 |
| 1596019 | 8/1981 | United Kingdom | 52/650.3 |

OTHER PUBLICATIONS

Borrego, John, *Space Grid Structures—Skeletal Frameworks and Stressed-Skin Systems,* MIT Press, Massachusetts Institute of Technology, (1968) pp. 3–7, 10–11, 15–19, 22–25, 43, 112–113, 132–137, 156–157.

*Cleanroom Components,* advertising brochure.

"Data Sheet" advertising brochure outlining specification and data, NUMA Technologies (May 1992).

"Evoluation" advertising brochure, NUMA Technologies (May 1992).

*Primary Examiner*—Carl D. Friedman
*Assistant Examiner*—Robert Canfield
*Attorney, Agent, or Firm*—Workman, Nydegger & Seeley

[57] ABSTRACT

A raised access flooring system is disclosed, which comprises a raised access flooring system module comprising a space frame web which is supported by adjustable pedestals, wherein the space frame web comprises a plurality of elongate structural members and a grid. A flooring member is fixedly attached to the web. The pedestals may be positioned under the grid. Some of the elongate structural members forming the web are inclined to the flooring member while those close to the edges of the web are more vertically oriented. This space frame arrangement economizes material usage and reduces cost compared to conventional modules. The module is so configured that it can be emplaced as a member of a flooring system, and is easily removable and interchangeable. In addition, because of the more efficient weight distribution afforded by the space frame design, portions of the web may be removed to accommodate electrical boxes without comprising the strength of the module to the degree such removal would compromise prior art modules utilizing ribs or post and beam construction.

13 Claims, 14 Drawing Sheets

RAISED ACCESS FLOORING SYSTEM

CONTINUATION-IN-PART

This application is a continuation-in-part application of U.S. patent application Ser. No. 07/726,988, filed Jul. 8, 1991, abandoned entitled RAISED ACCESS FLOORING SYSTEM naming as inventors Terry L. Daw and Kevin D. Moss.

BACKGROUND

1. The Field of the Invention

The invention is in the field of raised access flooring systems, which are typically used to provide space between a floor and a subfloor to provide air duct or to provide a space in which conduits, and electrical boxes may be located. The present invention incorporates a space frame like structure configured to provide a raised access flooring system with modules that are removable and interchangeable.

2. The Background Art

With the advent of computers and word processors, the need for raised access flooring systems has escalated. It has been found to be very economical to provide a flooring system in new construction, and even to modify old construction, wherein ready access is available to conduits, ducts, utilities, and other items so that additions to, and changes in locations of, electrical outlets, computer cable outlets, heating and cooling outlets, and the like can be readily made without major structural changes. This is of particular importance in today's economic environment wherein the cost of floor space is exceedingly high, thus leading to constant remodeling in order to make better use of available space.

Additionally, it has been found prudent to provide a flooring system wherein load-bearing capability can be modified to accommodate new equipment, or even one where different sections can have different load-bearing capabilities.

Additionally, for applications involving clean rooms, a raised access flooring system having a multiplicity of perforations in the floor above a subfloor provides a convenient means for continuous air circulation to remove unwanted contaminating particles. A flooring system such as this is also very beneficial in computer rooms wherein it is necessary to provide adequate and even cooling throughout the room.

Raised access flooring systems conventionally employ a multitude of floor modules supported on pedestals above a subfloor with the floor modules normally having a square configuration and arranged in a grid with respect to each other. A typical module is two feet square.

Prior art floor modules typically employ a thin flat plate stiffened by a ribbed grating, both being configured as one piece, as the flooring member. The module is supported at the corners by pedestals that interface the bottom of the grating. The grating must have sufficient strength to accommodate the expected floor loads without allowing rupturing or excessive bending of the plate beyond an industry-specified limit. This requirement dictates the dimensions of the thickness and depth of the ribs supporting the grating which, of course, is also dependent on the material used.

When an occasion arises wherein the load-bearing capability of some section of the floor must be increased, such as to accommodate a new piece of equipment, then the load-bearing capacity of the modules in that section must be increased. From an economics of material standpoint, this is effected by increasing the depth of the ribs in the grating. However, this could lead to a requirement to increase the thickness of all floor sections in order to maintain an even floor surface. This, of course, results in an expensive modification, and also a greater load on the subfloor.

For clean room and computer room applications perforations are sometimes formed in the flat plate to permit airflow therethrough, communicating with the space under the module.

Access ports must be provided in certain modules in order to provide passageways for conduits, ducts, cables, wiring, and other like utility items, to pass therethrough. Some modules require sawing to effect such access ports. This is a costly, time-consuming operation. Furthermore, such access ports inevitably reduce the load-bearing capability of the module, thus minimizing the size of the access ports that can be incorporated and/or further increasing the required stiffening of the plate.

Another problem with prior art modules relates to the increased depth of the module over and above that required to provide access space for utility wiring and the ducts formed between the floor and subfloor. Since prior art modules are supported from the bottom of the grating the access space plus the depth of the ribs in the grating dictate the total dimension that raises the floor above the subfloor. This, of course, reduces the floor-to-ceiling height of a room, an undesirable result.

OBJECTS AND BRIEF SUMMARY OF THE INVENTION

In view of the foregoing, it is an object of the present invention to provide a module that has a lower cost than the prior art modules.

It is another object of the present invention to provide a raised access flooring system module which is significantly lighter in weight than prior art modules.

It is still another object of the present invention to provide a module which is amenable to having needed access ports fashioned therethrough without experiencing a noticeable impairment of load-bearing capability and also a module wherein the access ports can be fashioned by punching rather than by sawing.

It is a further object of the present invention to provide a module wherein the load-bearing capability of the module can be configured to be greater or lesser than adjacent modules without necessitating a change in the entire floor level, thus providing a raised access flooring system wherein certain sections of the floor can have a greater load-bearing capability than other sections, and also wherein the remaining sections of the floor need not be strengthened unduly more than is required in order to provide a level floor.

It is a further object of the present invention to provide a module with the required access space between the floor and the subfloor while at the same time having a depth only slightly greater than the required access space.

Another object of the invention is to provide a module that allows for adequate and adjustable air flow to occur from the space above the floor to the space between the floor and the subfloor, both to provide vertical laminar flow in clean rooms to remove contaminants, and for use in computer rooms to provide adequate cooling air.

Yet another object of the invention is to provide a module that has provisions, in cooperation with supporting pedestals, for interfacing and interconnecting adjacent modules.

A further object of the invention is to provide a module that can be readily removed when necessary, reconfigured if desired, and replaced in the same or in a different orientation.

A still further object of the present invention is to provide a module satisfying the above objectives that is readily usable with all four markets for raised access flooring systems, e.g., aluminum flooring, steel flooring, concrete flooring, and steel-encased wood-core flooring.

The unique design of the present invention permits the achievement of all the above objectives as well as others that will become apparent as the invention is described.

The present invention utilizes a space frame structure having a base grid and a web which fixedly engages the bottom of an attached flooring member at a multiplicity of positions. The web and grid are configured so as to absorb a large fraction of the tensile stress that would otherwise be taken by the flooring member. The advantage of this is that a much thinner and thus lighter-in-weight flooring member can be utilized with the present invention than with conventional modules of the prior art. It has been found that approximately one-third of the total modular weight can be saved with the arrangement of the module of the present invention over conventional raised access system flooring modules of the prior art.

The space frame structure of the present invention comprises a web constructed of a multiplicity of interconnected elongate structural members, preferably fashioned as rods, and preferably, but not necessarily, configured as a multiplicity of interfacing and interconnected pyramidal cells, each having a base, side faces, and an apex. As is customary with pyramids, the perimeter of each cell base comprises a number of vertexes, connected one to another by rods. The side faces are also defined by inclined rods, each running from a vertex to the pyramid apex. Adjacent cells have rods forming corresponding segments of their perimeters interfacing each other. Preferably a single rod is shared by two adjacent cells, thus automatically serving to interconnect the cells.

Additionally, of course, the rods forming the cell bases together comprise the base of the module, termed the grid. Preferably the grid of the module will be configured as a square.

The apexes of all the cells lie in a common plane and may have short posts integral therewith, vertically oriented, which can serve to engage the flooring member by means of receptors affixed to the flooring member. Alternately, the apexes of the cells may terminate in a flattened area in which a threaded hole is machined. Flooring members may then be screwed onto the apexal plane to form a flat floor.

Although pyramidal cells are presently preferred, other arrangements could be utilized. Inclined rods could run from the cell bases to the common plane by courses which do not necessarily result in pyramids.

In fact, such an alternate arrangement is utilized in some embodiments to strengthen the edges of each module. As the pyramid shape is interrupted by the termination of the module at its edge, vertical rods may be used which extend from the outer edge of the grid upward to the outer edge of the module.

The space frame structure is preferably, but not necessarily, cast as a unitary structure which is later attached to a separately fabricated thin plate flooring member. Thus, the interconnections of the rods will preferably be achieved without the use of any auxiliary fastening devices such as screws, bolts, clips, and the like, and without the use of welding, brazing, soldering, gluing, and the like. This contributes significantly to a minimization of costs and weight.

In the present invention, the tensile stress is distributed among the flooring member, the web, and the grid of the space frame module. Because of this design, it is possible to cut access ports in the flooring member without having to cut the web and grid of the space frame structure or substantially weaken the module. Access ports are needed in certain modules to provide means for cables, conduits, and ducts, to pass through the floor. This is in contrast to prior art designs where the cutting of access ports results in the substantial weakening of the underlying support structure.

Hence, larger access ports can be fashioned in the flooring member of the present invention as compared to the prior art designs. Alternatively, an access port of the same size can be fashioned with less impairment of the load-carrying capability of the module.

The separately-fabricated flooring member also results in another significant advantage—access ports can be punched through the flooring member with readily-available equipment whereas the prior art flooring members require sawing. Likewise, air holes can be punched rather than drilled. This saves a considerable amount of time, and thus cost. As an example, air holes can be punched in 20 seconds whereas drilling requires four to seven minutes. Further, the design of the present invention provides for an inexpensive and readily accessible air damper which allows for controlling and adjusting the amount of air passing through the floor member.

A flooring member of the present invention also readily permits turned-up edges to be fashioned along the perimeter, which in turn accommodates the usage of vinyl, carpet, tile, or other floor covering materials to be utilized wherein the top surface of the floor covering is flush with the top of the turned-up edges.

It is also possible with the present invention to provide a module having a concrete or asphalt surface. This is readily accomplished by filling the top portion (or all) of the web and grid of the space frame structure with concrete or asphalt.

The space frame structure is preferably constructed by high pressure die-casting a unitary network of interfacing and interconnected pyramidal cells. The pyramidal cells have cell bases which are preferably interconnected in a repetitive space-filling pattern. When the base of each cell forms a square, triangle, a parallelogram, or a hexagon, the cells can all be alike and will form a space-filling pattern. Other space-filling patterns, however, can be effected by intermeshing a combination of shapes. As an example, cells having pentagonal bases can be intermeshed with cells having parallelogram bases in a space-filling pattern. Other combinations can also be effected. It is presently preferred to use pyramidal cells having square bases.

As with existing modules, supporting pedestals are utilized to support the modules above a subfloor, and to permit leveling. The pedestals preferred for use with this invention are similar to conventional pedestals except that a unique pedestal head is employed. The pedestal head of the invention comprises means for interfacing and securing the corners of the bottoms of the flooring members of adjacent modules to the pedestal head, and also incorporates slots through which the top ends of the inclined rods at the corners of the web can pass without interference with the pedestal head. The leveling is accomplished by a conventional threaded nut engaging a conventional jack screw which adjusts the height of the pedestal head.

The means for supporting the module above the subfloor and for interfacing and interconnecting it to adjacent modules comprises an adjustable pedestal with a specially configured pedestal head.

Another embodiment of the means for supporting comprises peripheral outwardly inclined rods as a part of the web, the upper ends of which interface the flooring member near the perimeter of the flooring member. Other embodiments of the means for supporting include a turned-down lip, or alternatively, an added beam provided along the perimeter of the flooring member.

It may be necessary, to configure the pedestal head so as to interface the flooring member or grid and any involved peripheral rod properly. In order to secure the flooring member to the pedestal head, bolt holes are provided in the flooring member which align with threaded bores in the pedestal such that the flooring member could be bolted to the pedestal head. The pedestal head is configured so as to have four similar quadrants, each capable of supporting the corner of a flooring member. Thus, four space frames can be assembled in an adjacent fashion.

In some embodiments, the grid is supported instead of the flooring members, or a combination of grid and flooring members may be supported.

In summary, the raised access flooring system module of the present invention, together with supporting pedestals, provides a unit which fulfills the stated objectives, and which also provides means whereby a plurality of modules may be supported above a subfloor and interfaced and interconnected, thus resulting in a system whereby a complete floor may be positioned above a subfloor with the requisite space between the floor and the subfloor. A floor covering may then be emplaced over the floor, as desired.

The unique advantages of the invention can be further recognized by a brief discussion of its use. A user will install a number of modules in an adjacent interconnected configuration so as to form a flooring system. As noted above a pedestal will support and interconnect four interfacing modules by interfacing a corner of each flooring member or a corner of the grid. A leveling adjustment on each pedestal permits the floor to be leveled.

There may be other positions along the floor wherein a heavier load-bearing capability is required than for the remainder of the floor. Again, in such locations special modules will be employed which are configured so as to accept such greater loads. Note that the use of such modules does not result in an uneven floor level.

Of course, as the modules are emplaced, the required ducts, cables, conduits and the like are routed through the access space between the floor and the subfloor. Due to the openness of the web such items may pass right through the web, if desired.

After a flooring system has been completed it seems almost inevitable that changes will later be required. In such an event, any of the modules may be removed and replaced with other modules having differing load-bearing capabilities or differing access port configurations. Likewise, any module may be rotated so as to reposition an access port, if desired.

Thus it can be seen that a great degree of flexibility is provided by the invention, in a more economical manner than with prior art flooring system modules.

One final advantage of the present invention concerns the ability of the flooring system to serve as a modulator or damper of air flow through a room. In many situations, but particularly clean room applications, it is desirable to direct the flow of air through a room. By creating a vertical laminar flow through a clean room, particulates can be prevented from passing from one work area to another within the room. Filtered air is typically introduced through the ceiling and is emitted in a downward direction. Objects and equipment placed in a room interrupts this downward vertical flow of air. To counteract the effect of the flow deviations caused by objects in a room, the holes placed in the flooring member of each flooring module may be partially or totally occluded to effect the flow of air through the floor module. After passing through the flooring modules, air enters the space beneath the modules created by the pedestals supporting the modules. This area acts as a large duct through which the air returns to the filtration system.

As will be explained in more detail later, one advantage of the present invention is that the construction of the module as a web instead of using the vertical ribs of the prior art allows air to flow relatively unimpacted through the floor module in both a vertical and a horizontal direction. As a result, less space is required between the flooring member and the subfloor in the space created by the pedestals. In typical installations, the pedestal space may be reduced by as much as two (2) inches.

This reduction in required pedestal space allows more flexibility in supporting the web and flooring members. For example, as the web area can be effectively considered a portion of the pedestal space, the webbing can be supported at the grid instead of at the level of the flooring member. This flexibility of support allows the configuration of the web at its outer edges to be altered as those outer edges need no longer be constructed to allow passage of a pedestal therethrough. When the flooring modules is supported at the grid, the edges of the web may be manufactured with vertical rods, As these vertical web rods can be directly supported by a pedestal placed under the grid directly under the vertical rod, the strength of the outer edges of the web is increased without the need for other strengthening strategies such as the utilization of additional rods or upturned edges on the flooring member itself.

On such strengthening strategy used in several embodiments of the present invention utilizing angled rods at the edges of the web comprises a gusset located with its right angle at the lower, outer edge of the web. This gusset strengthens the corner of the module and also permits placement of a pedestal at the lower edge of the gusset in the same plane as the grid thereby indirectly supporting the flooring member and obviating the need to configure the rods at the corner of the web so that a pedestal may pass through and support the flooring member directly.

DETAILED DESCRIPTION OF THE PREFERRED EMBODIMENTS

Figure 1:
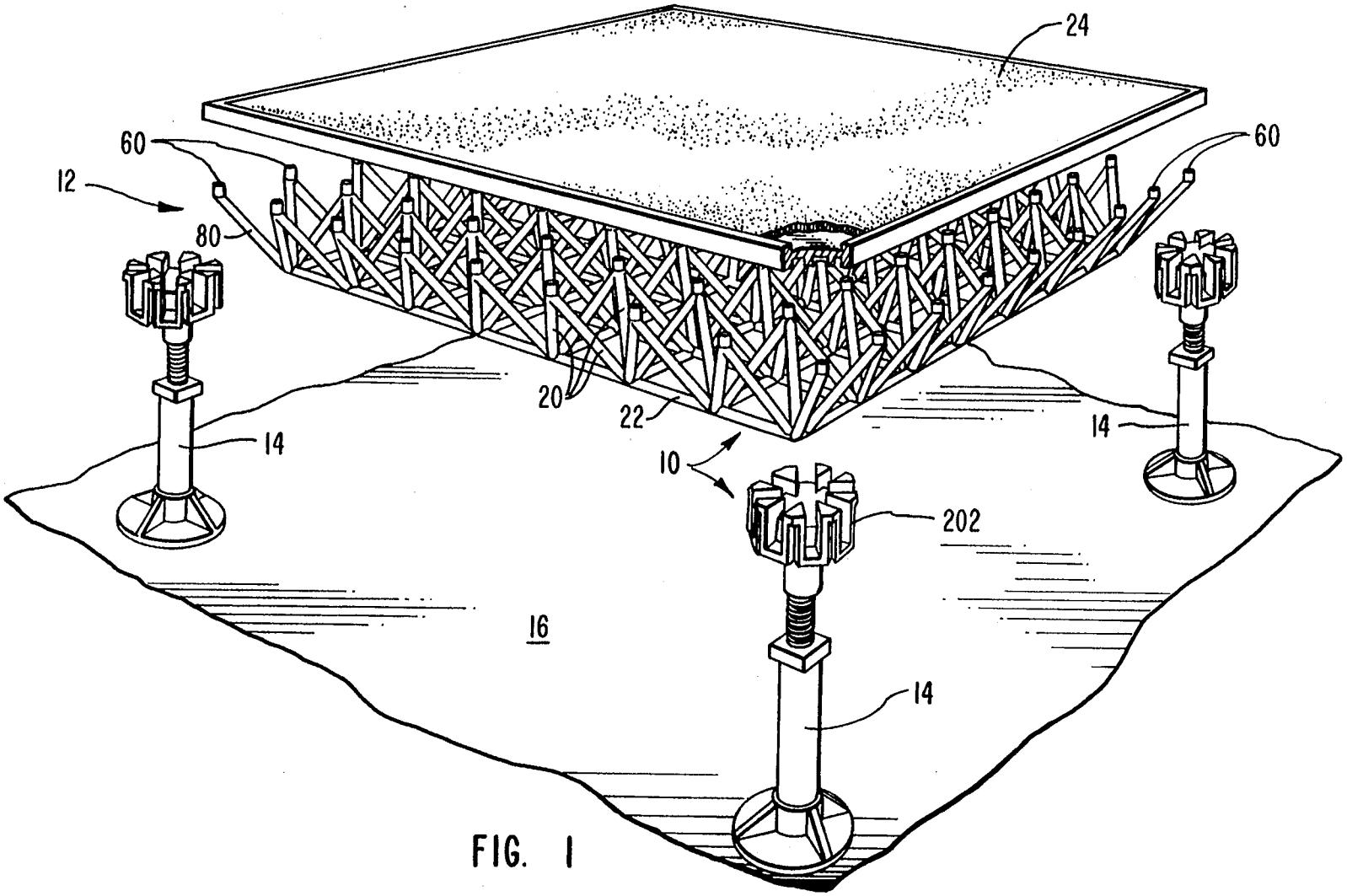
FIG. 1 is an exploded partial perspective view of a preferred embodiment of the space frame structure of the invention, showing the web and the grid forming a multiplicity of pyramidal cells, plus the flooring member, and supporting pedestals.

As noted above, the present invention comprises a raised access flooring system. The system comprises a raised access flooring module which is supported by pedestals at its corners. The module comprises a web, grid, and a flooring member configured as a space frame structure. Space frame technology is discussed below in order to aid in differentiation of prior art space frames and the space frame structure of the present invention.

A. Space Frame Technology

Space frames have traditionally been used for large permanent structural installations, such as support for long-span roofs. Prior art space frames are fashioned in a variety of configurations. Typically, a space frame will have a bottom grid, a web and a top grid. The web consists of a multiplicity of interconnected steel I-beams, mostly running at angles to the perpendicular and on occasions running vertically, between the bottom grid and the top grid. The web is typically fashioned as a multiplicity of pyramidal cells with their apexes positioned at the top of the space frame with the remaining base vertexes positioned at the bottom of the space frame.

The top and bottom grids consist of a multiplicity of interconnected bars, arranged horizontally. The bottom grid is connected to the bases of the web pyramids.

The pyramidal cells are normally configured such that their bases will comprise a space-filling pattern, such as triangles, squares, or hexagons. Sometimes other shapes are employed which then require the use of a combination of shapes to comprise a space-filling pattern. The use of space-filling patterns maximizes the structural integrity of the space frame while minimizing cost and space.

The interconnections between the bars of the web and the grids are effected by the use of mechanical joints such as balls with threaded bores for receiving bolts attached to the ends of the bars. Various other joining means are also employed such as clips or angled brackets. Welding may also be employed.

It is important to note that such prior art space frames are devised for use in large structures wherein they are permanently emplaced. They are not devised to be replaced or interchanged; in fact, removal of one portion would cause collapse of the entire frame.

B. The Flooring System Module

The flooring module of the present invention is configured so as to comprise a web and a grid and a separately fabricated flooring member attached to the upper surface of the web. As such, the module is typically configured so as to have dimensions approximately 24 inches by 24 inches. The module is not configured so as to support a large structure such as a roof of a building. The module is configured so as to be emplaced above a subfloor, supported on pedestals, and so as to be easily removed and replaced by a laborer with only the use of manual force.

The flooring module is also configured so as to interface, and to be interconnected to, adjacent modules, the whole thus forming a floor. The module is configured such that perforations incorporated in the flooring member allow air to flow through the web relatively unobstructed. Similarly the module may be used as a floor of a computer room wherein cooling air is caused to flow through the perforations. Optionally, a concrete or asphalt surface can be formed around or above the web to function as the flooring member.

The raised access flooring system 10 of the invention comprises a space frame structure, or module 12, and a plurality of pedestals 14 configured so as to support module 12 above a sub-floor 16 as shown in FIG. 1. The space frame structure comprises a web 20, a grid 22, and a flooring member 24. Web 20 and grid 22 are fashioned from a multiplicity of elongate structural members, termed rods if their diameter is greater than 3/16 of an inch, and termed wires if their diameter is smaller. The size will depend on the load-bearing requirement. Preferably, but not necessarily, in order to economize on material, the web and the grid are fashioned from round rods having a diameter in the range of about $\frac{1}{8}$ inch to about $\frac{1}{2}$ inch. Elongate structural members having cross sections other than round may be used. In any event they will be termed rods hereafter.

Rods fashioned from aluminum and having a diameter of about 3/16 inch are suitable for use in the present invention wherein the load-bearing capability must be about 325 pounds per square foot, and wherein the point load capability must be about 1250 pounds per square inch at any point on the flooring member.

The rods of the web preferably, but not necessarily, all have the same diameter for simplicity of design. The grid, however, may be constructed of rods having a greater diameter than the web. A detailed stress analysis for each rod, for a given load, would reveal which rods could be smaller than others.

Figure 2:
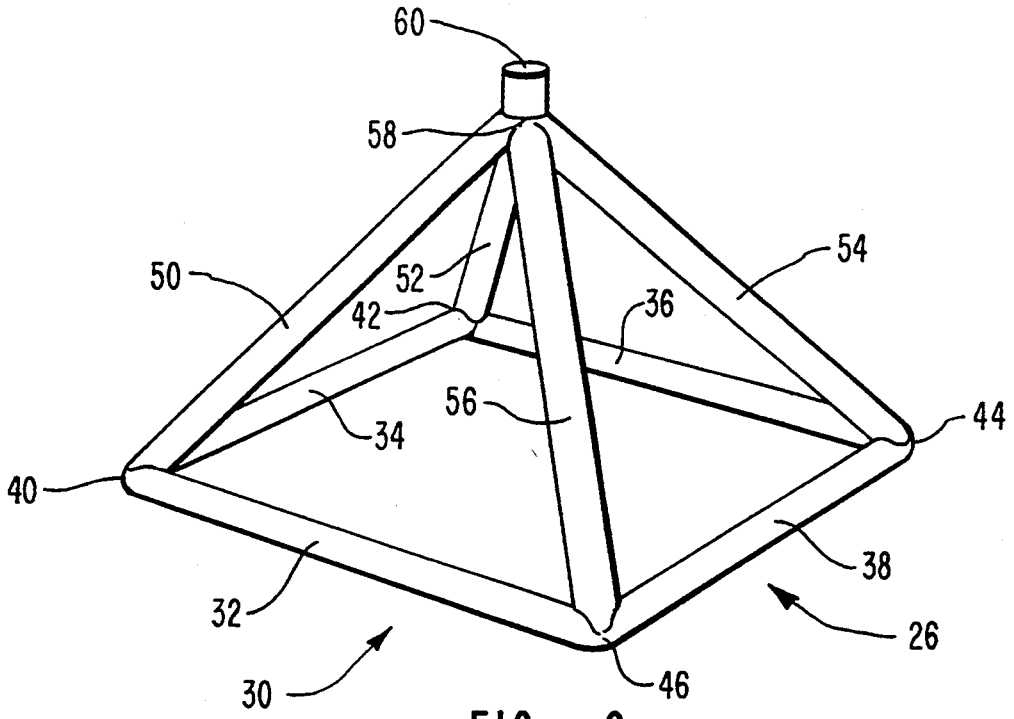
FIG. 2 is a perspective view of a single pyramidal cell drawn to a larger scale.

Each pyramidal cell, such as cell 26 of FIG. 2, has a square base, such as 30, fashioned from rods 32, 34, 36, and 38, with each rod forming a segment of the perimeter of the base and their junctions forming vertexes 40, 42, 44, and 46. Inclined rods 50, 52, 54, and 56 form the faces of the pyramid with the rods meeting at an apex 58. Also shown is a short post 60, to be described later, integral with the apex. The apexes of all cells lie in a common horizontal plane, which is parallel to the plane of the flooring member to be described later.

Figure 3:
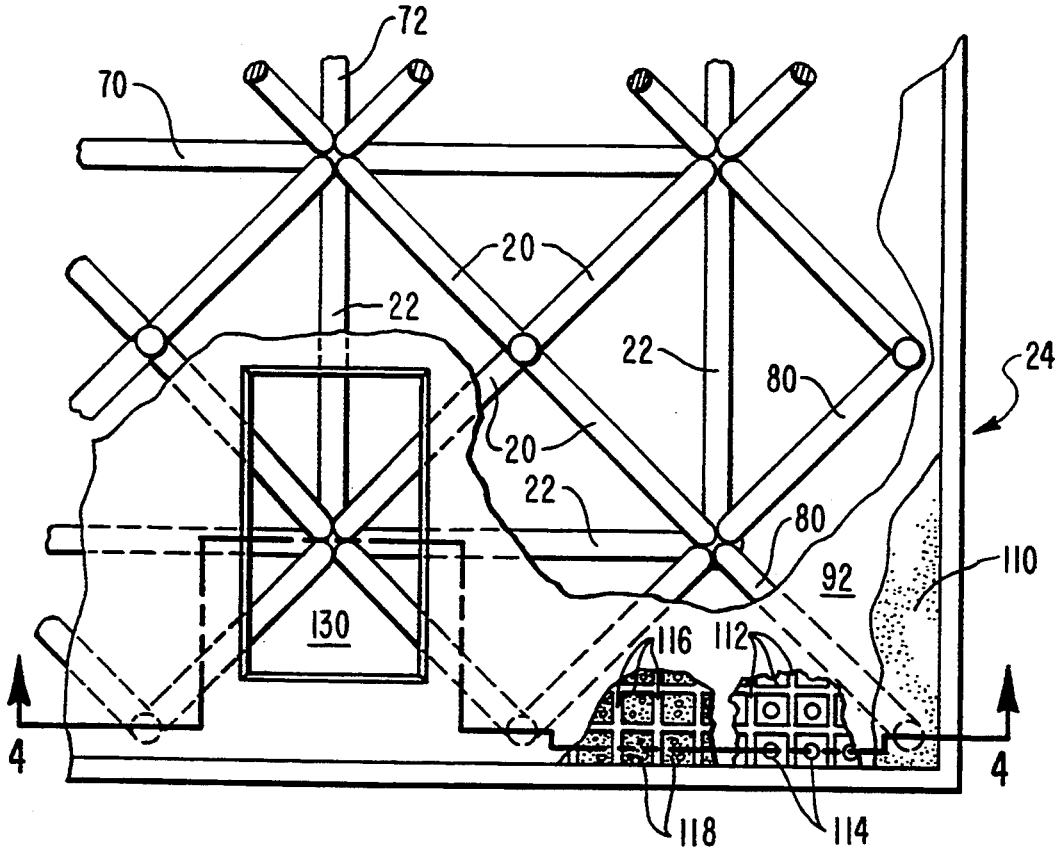
FIG. 3 is a partial plan view of the space frame structure drawn to a larger scale, partially cut away, and showing the various embodiments of the flooring member.

Interfacing pyramidal cells preferably share a common rod as a segment of their interfacing bases in order to economize materials, such as rods 70 and 72 shown in FIG. 3. As an alternative, certain interfacing cells could maintain, and interconnect, their separate interfacing rods such as for situations wherein a strength analysis indicated that certain interfacing segments experienced a greater stress than others.

By way of example, for concentrated floor loads of approximately 1250 pounds per square inch, the angle should preferably be about 40°, the inclined rods should preferably have a length of about 3 $\frac{1}{4}$ inch, and the grid rods should preferably have a length of about 3 inches.

It is also presently preferred, although not required, that each flooring module be comprised of a requisite number of cells such that the grid forms a square having dimensions within the range of about 2 inches by 2 inches to about 5 inches by 5 inches, and also wherein the four sides are symmetrical such that the flooring module can be oriented in differing orientations in the flooring system.

Figure 5:
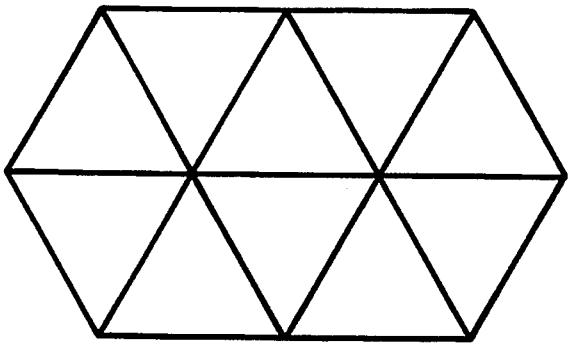
FIG. 5 is a schematic representation of a pattern of cells having triangular-shaped bases.
Figure 6:
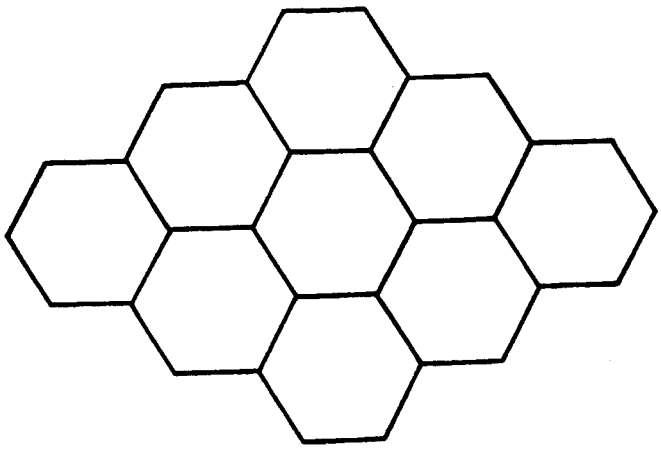
FIG. 6 is a schematic representation of a pattern of cells having hexagonal shaped bases.
Figure 7:
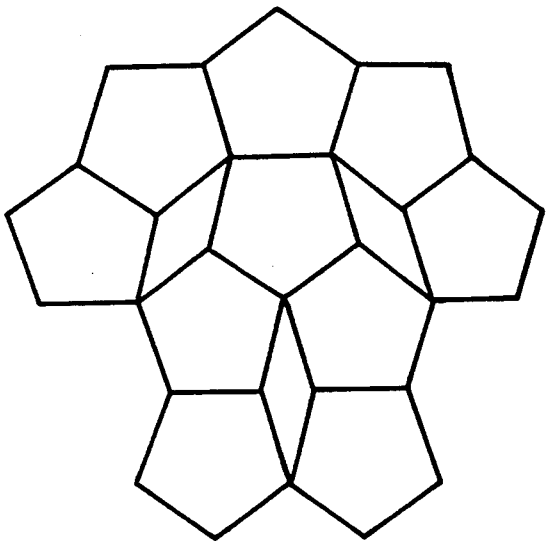
FIG. 7 is a schematic representation of a pattern of cells having an intermixture of pentagonal and parallelogrammal shaped bases.

Although it is presently preferred to utilize pyramidal cells having square bases, pyramidal cells having other shaped bases can be used. In this event, cells are preferred wherein their interfacing bases result in a space-filling pattern. The only cells having straight rods which fulfill this requirement are those having triangular bases, parallelogrammal bases, or hexagonal bases. Schematic arrangements of the bases of the cells having such shapes are shown in FIGS. 5, 6, and 7. It should be noted, of course, that squares and rectangles are merely special forms of parallelograms.

Space-filling patterns can also be achieved with cells having bases other than those noted above, provided different shaped cells are intermixed. Thus, as shown in FIG. 7, an intermixture of pentagonal and parallelogrammal-shaped bases will form a space-filling pattern. There are a large number of other such possibilities, too numerous to be illustrated herein, but all considered to be within the scope of this invention.

Stated another way, any arrangement of cells, having bases of whatever shape, which form a repetitive pattern of enclosed areas, of whatever shape, are considered as forming a space-filling pattern which comes within the scope of this invention.

Figure 4:
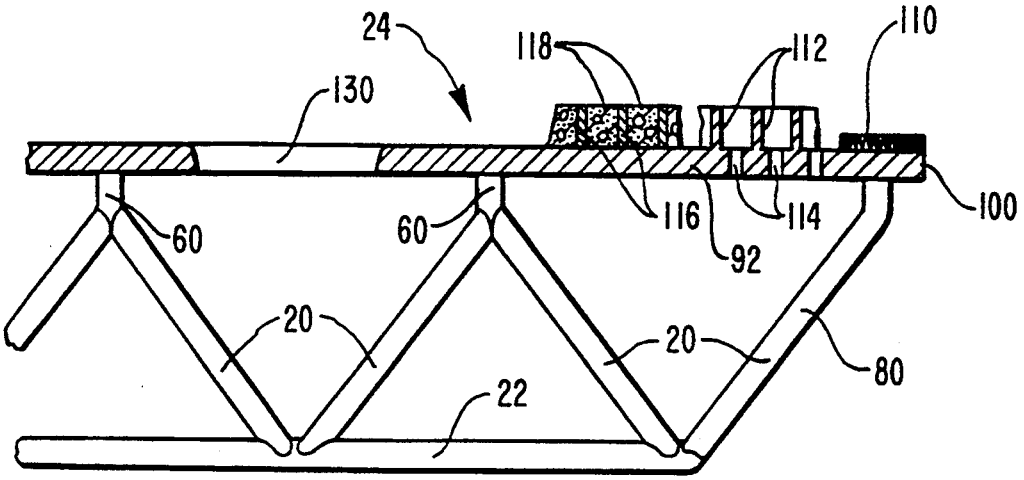
FIG. 4 is a partial elevation view corresponding to FIG. 3, with a partial cross-section taken along the lines 4—4 of FIG. 3.

As noted in FIGS. 1, 3, and 4, the web may have peripheral and outwardly inclined rods, such as 80, which are attached at their lower ends to vertexes of cells which are positioned along the perimeter of the grid. The upper ends of these rods lie in the same plane as the apexes of the pyramidal cells, and have similar vertically disposed posts so attached thereto.

These peripheral rods serve to strengthen the portion of the flooring member near the perimeter of the flooring member by sharing the stress that would otherwise be borne by the flooring member alone in the peripheral regions. This arrangement permits the flooring member of the space frame structure to have its perimeter outside the perimeter of the grid, or in other words permits the flooring member to have somewhat larger dimensions than the grid, such as being approximately 24 inches by 24 inches, whereas the grid has dimensions approximately 21 inches by 21 inches.

This configuration is useful since it provides space outside the grid wherein the supporting pedestals, to be described later, can be emplaced. This, then, permits the space frame structure to be supported from the flooring member rather than from the grid or the web, which in turn results in the module having a shallower dimension between the flooring member and the sub-floor than would otherwise be the case. This is a very important consideration in many installations, particularly for remodeled older structures, since this space reduces the space between the floor and the ceiling. In applications wherein the web is supported from the grid, vertical rods may be employed at the outer edges of the web to support the outer edges of the flooring member.

Figure 9:
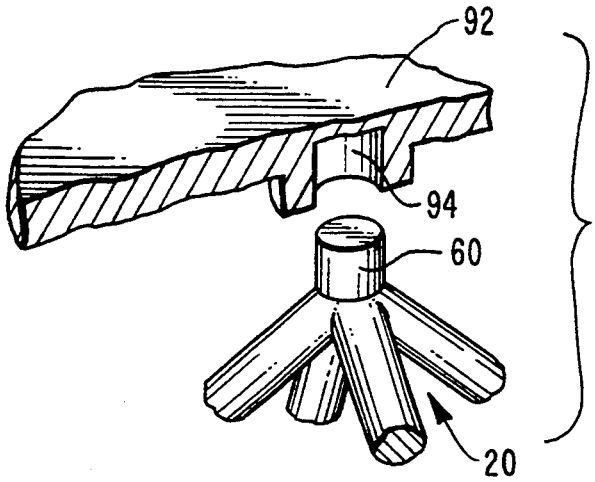
FIG. 9 is an exploded view showing a post of the web and a receptor of the flooring member.

The flooring member 24 will now be described. As shown in FIGS. 3 and 4, the flooring member 24 preferably comprises a cast substantially planar plate 92 with a floor covering to be described later, emplaced thereon. The planar plate preferably has receptors such as receptor 94, as shown in FIG. 9. Receptors 94 preferably comprise short tubular members configured so as to engage posts 60 of the web. Posts 60 and receptors 94 are so configured and sized as to provide a press-fit therebetween. Thus, planar plate 92 and web 20 are permanently affixed to each other by pressing them together such that posts 60 are fully engaged with receptors 94. Posts 60 are slightly tapered so as to facilitate this press-fit.

Figure 13:
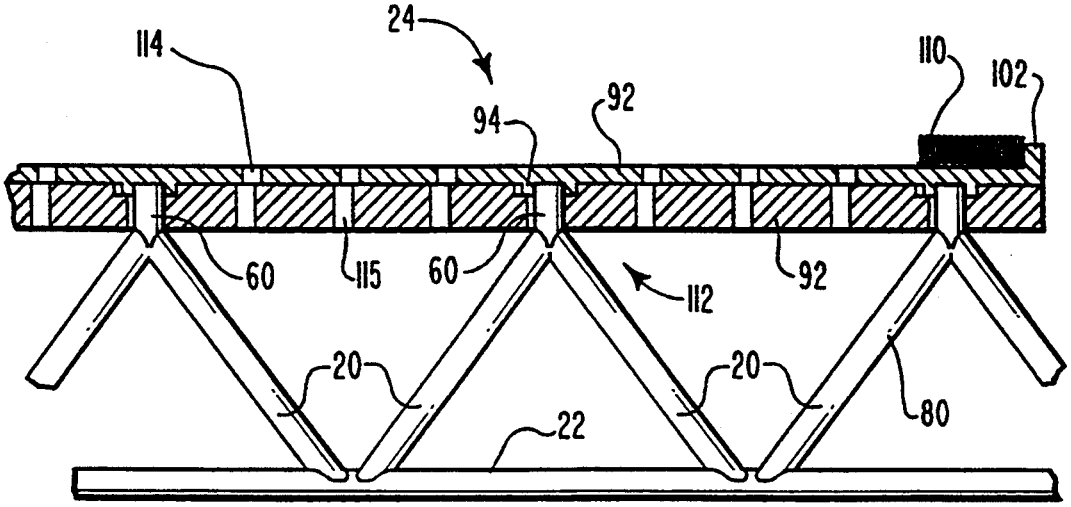
FIG. 13 is a partial elevational view of the space frame structure similar to FIG. 4, wherein an air damper is illustrated.

Receptors 94 may alternatively comprise recesses formed in plate 92 as shown in FIG. 13. Such recesses could be preferable over the tubular members for applications wherein the plate thickness is adequate since it could be more economical to provide such receptors rather than the tubular members.

Figure 8:
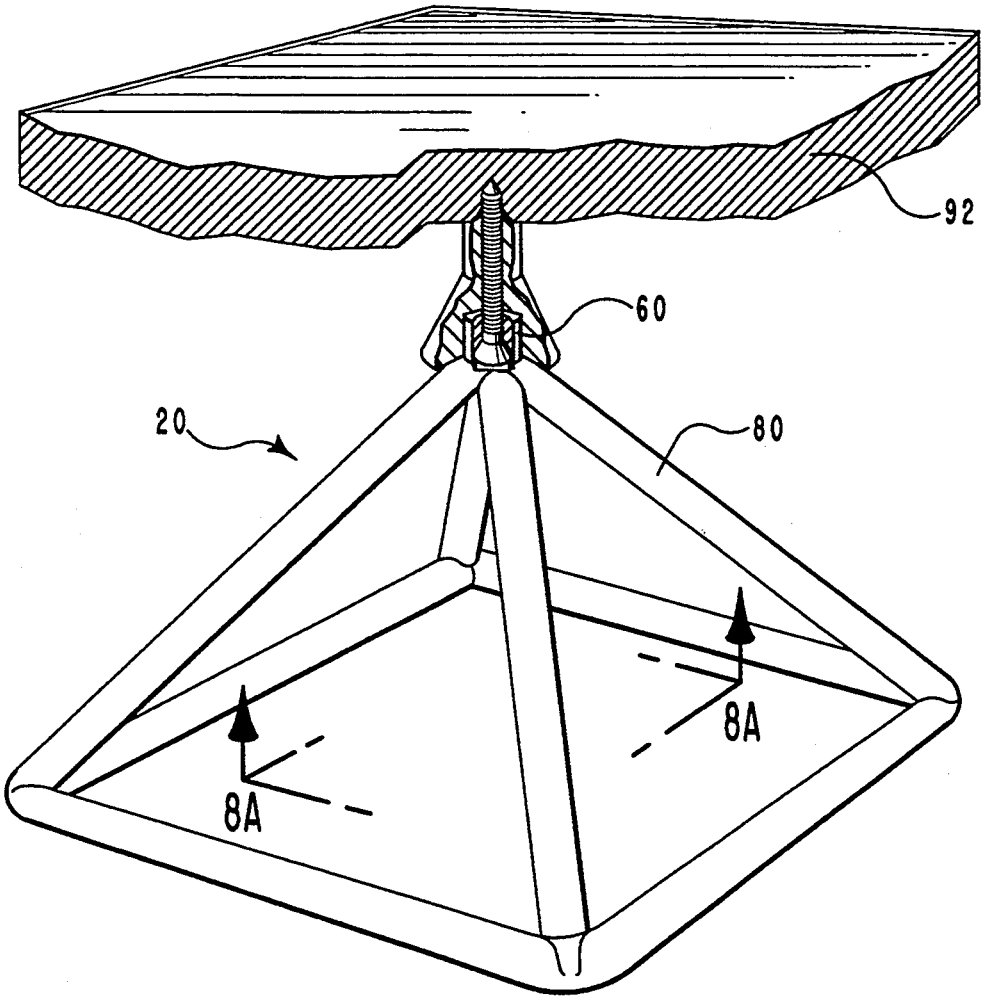
FIG. 8 is a partially cut-away view illustrating a post of the upper portion of the web to which is screwed the flooring member.
Figure 8A:
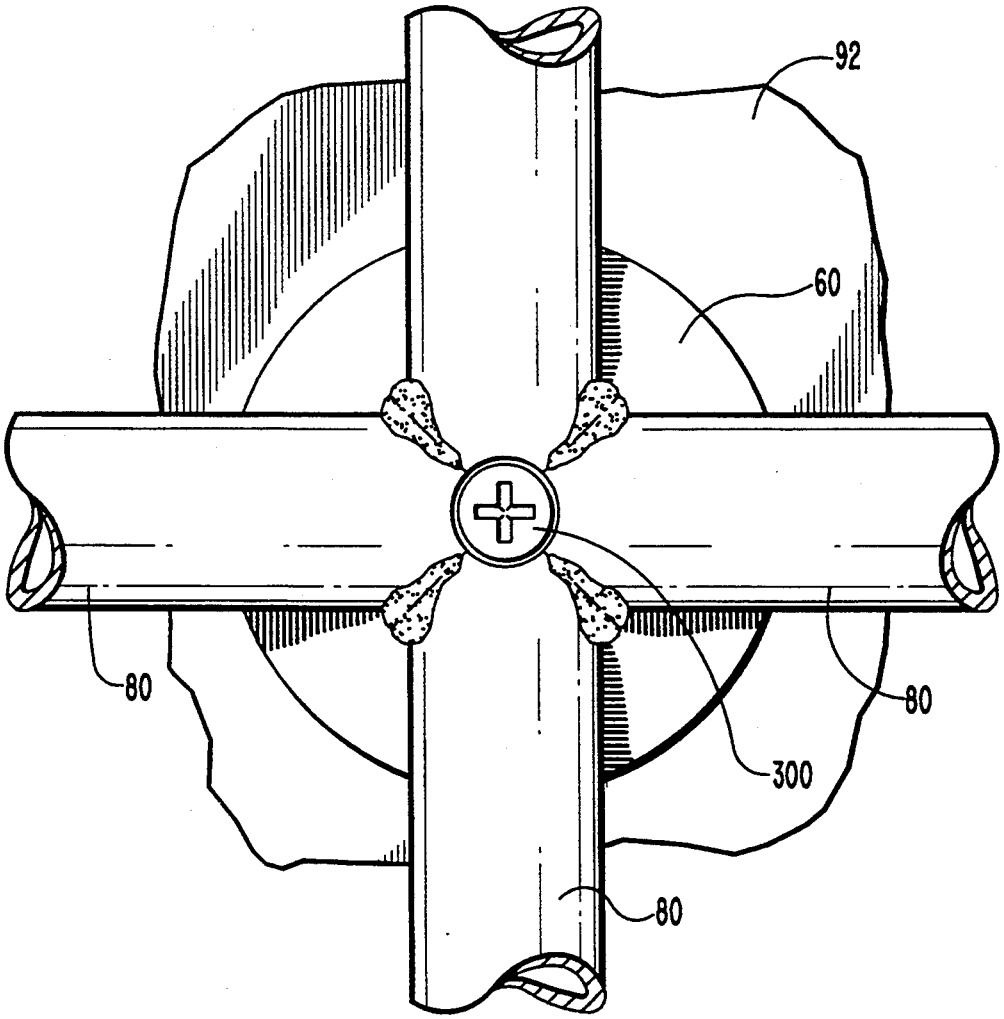
FIG. 8A is a bottom view of FIG. 8.

FIG. 8 illustrates an alternative means of securing the flooring member 92 to web 20 (partially shown) using a conventional screw placed through post 60 fabricated with a receptor thread. Web 20, as partially shown in FIG. 8, is part of a larger space frame structure.

Planar plate 92 also preferably has a turned-down stiffening lip or added beam 100 positioned along its perimeter as shown in FIG. 4. This lip is fashioned preferably as a part of the casting. This lip serves to strengthen the edges of the plate against bending, acting as a beam. This lip or beam is hereafter called a turned-down stiffening lip.

Although not presently preferred, plate 92 may also have a turned-up lip 102 positioned along its perimeter as shown in FIG. 4. This may be fashioned in the same manner as turned-down stiffening lip 100. Turned-up lip 102 then permits a flooring material, to be described later, to be emplaced within the confines of lip 102.

Planar plate 92 is preferably fashioned from a structural material such as aluminum, steel, graphite, or plastic although other materials may be used. The particular material chosen will depend on the application. It is presently preferred that aluminum be used, and also that the plate be fashioned by casting.

Planar plate 92 will normally have a floor covering material 110 emplaced thereon as shown partially in FIGS. 3 and 4. This floor covering material may comprise carpeting, vinyl, linoleum, tile, or other suitable material. Preferably, when a hard material like tile is used, the thickness of the material is such that the surface is substantially flush with the upper edge of turned-up lip 102. Preferably, when a soft material like carpeting is used, turned-up lip 102 is lower than the surface of the material or is not incorporated in the plate.

For clean room and computer room applications, a multiplicity of holes such as 114 are fashioned, by punching, through plate 92 as shown partially in FIGS. 3 and 4. Thus, by external means, not shown, an air flow may be maintained from the space above the floor, through the floor into the space between the floor and the sub-floor, and out. The openness of the web is conducive to this airflow as well as the space below the grid and the sub-floor.

For applications wherein a concrete, asphalt, or equivalent floor is desired, such material 116 can be placed on the flooring member so as to form a smooth upper surface 118, as shown in FIG. 4. Surface 118 is particularly useful in applications wherein oil, grease or other liquids could be spilled on the floor.

Figure 12:
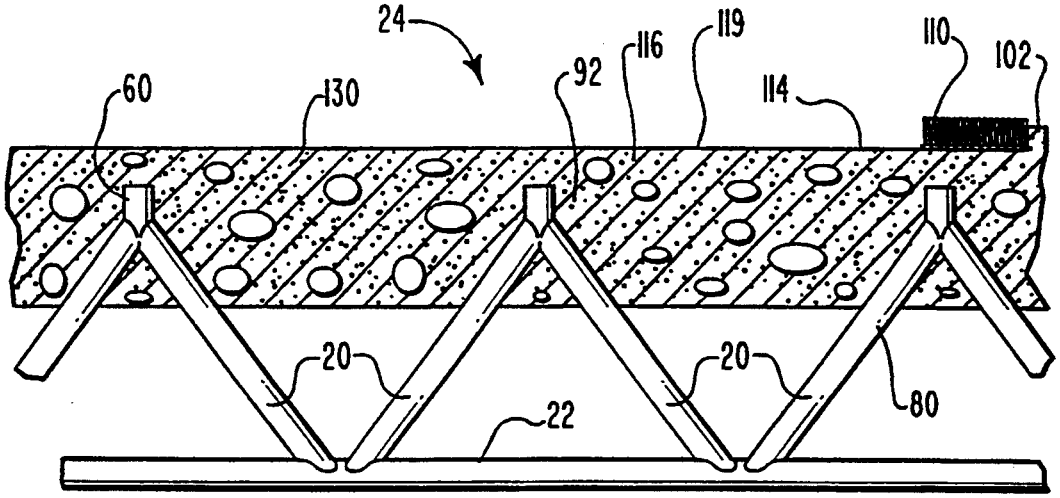
FIG. 12 is a partial elevation view of the space frame web similar to FIG. 4, wherein the web and grid is shown embedded into concrete to form a solid flooring surface.

It has been found convenient to form a module having a concrete (or asphalt or similar material) support material for its upper surface by placing the concrete into a form and then embedding the upper portion of the web and grid of the space frame into concrete 116, as shown in FIG. 12. After the concrete 116 has cured and the flooring module is securely attached to the concrete, the module can be removed from the form. It will be appreciated that the entire web and grid structure can be filled with concrete. While such a structure will be much stronger and provide more rigidity to the structure, it will also be much heavier. Hence, those skilled in the art will want to balance the needed strength while minimizing the total weight of the module.

preferably, but not necessarily, the web and the grid are fashioned together as an integral casting utilizing a castable material such as aluminum. It has been found that the preferred way to cast this structure is by high-pressure die-casting. Although aluminum is presently preferred, other materials may be utilized such as steel, graphite, plastic, and the like.

As noted above, casting is the presently preferred method of fabrication. By casting, the interconnections between the ends of the rods forming the grid and the web, including the short posts at the top of the web, are effected without the use of auxiliary fastening means such as bolts, screws, clips, angled members, and the like. Likewise, operations such as welding, brazing, soldering, gluing, and the like are unnecessary. This, of course, results in economy of manufacture.

Figure 10:
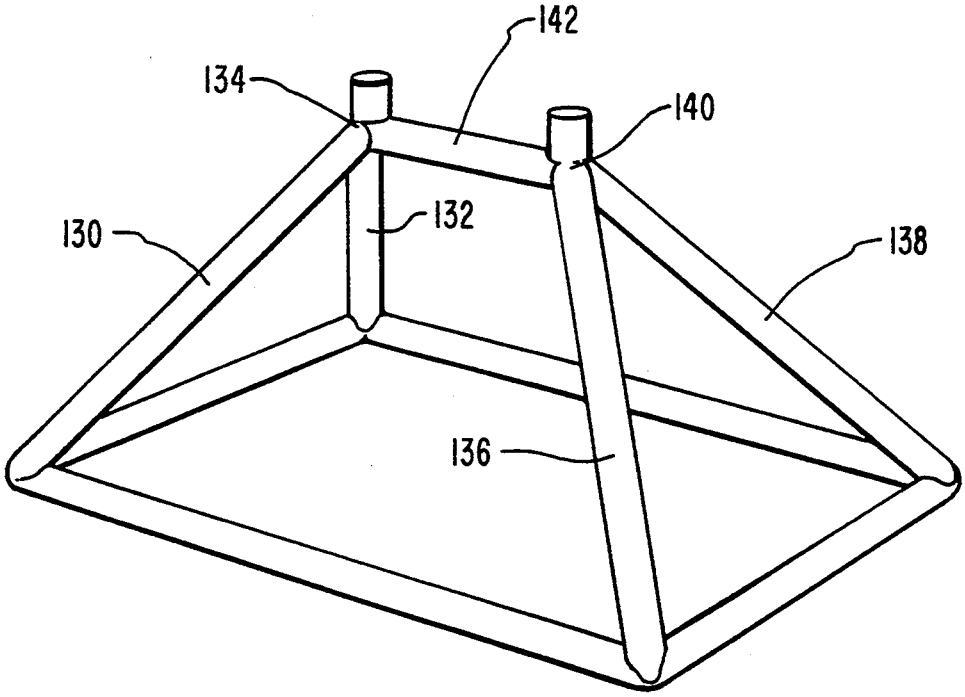
FIG. 10 is a partial schematic perspective view of another embodiment of this invention showing a configuration of a cell of the web that is not pyramidal.

Although the web and the grid are preferably configured as pyramidal cells, as explained above, other configurations may be employed that are considered to be within the scope of this invention. As an example, as shown in FIG. 10, inclined rods 130 and 132 may be joined together at their upper ends in apex 134, and inclined rods 136 and 138 may be joined together at their upper ends in apex 140. Additionally, to effect greater strength, apexes 134 and 140 may have a horizontal rod 142 interconnecting them. With or without rod 142, this structure is not considered a pyramid but will function satisfactorily.

There are a multitude of other configurations that can be envisioned, too numerous to describe herein, all considered to be within the scope of this invention, wherein a web comprising inclined elongate structural members and a grid comprising substantially horizontally disposed elongate structural members are employed. The key considerations are that there be a sufficient number of inclined elongate structural members, of sufficient strength, interfacing the flooring member at a sufficient number of positions spaced closely enough together, to support the required load.

The flooring member 24, when located in certain positions in a resultant floor, must also have access ports passing therethrough for accepting utility ducts, cables, conduits, and the like, to pass therethrough into the space between the floor and the subfloor. One such access port 130 is shown in FIGS. 3 and 4. These access ports are comparatively large openings passing through the flooring member and are configured and emplaced such that the rods of the web are not adversely impacted. That is, the access ports can be cut through the flooring member without cutting the web and grid of the flooring module. Thus, less structural integrity of the raised access flooring module is lost by incorporating access ports in the present invention as compared with prior art modules where the underlying supporting structure must be cut in order to form access ports of any size in the flooring member.

Furthermore, since flooring member 24 is a relatively thin plate, fabricated separately before being attached to the web, such access ports, or other perforations, can be punched rather than sawed or drilled as is required by prior art modules wherein a grating is fabricated integrally with the floor plate.

Figure 11:
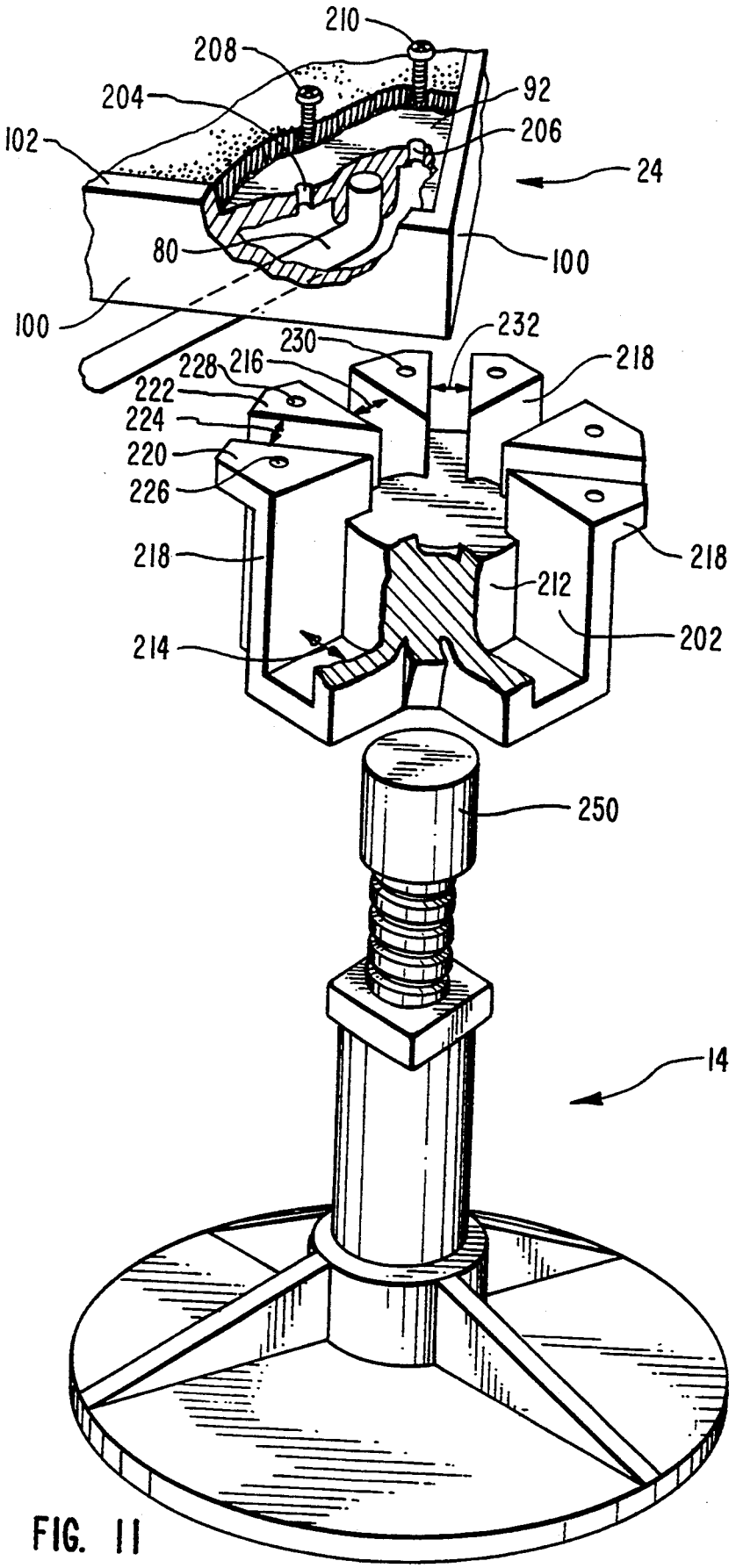
FIG. 11 is an exploded perspective view of a supporting pedestal showing a cut-away view of a pedestal head and a corner of the flooring member which engages the pedestal head.

The means for supporting the module and for interfacing and interconnecting the same to adjacent modules will now be described. As shown best in FIG. 11, a conventional pedestal 14 is topped by a special and unique pedestal cap 202 shown cut away for clarity. Flooring member 24 is also shown having planar plate 92 with turned-down stiffening lip 100 and turned-up lip 102 (cut away for clarity). It will be appreciated that under many circumstances, a lip may not be necessary. For example, the lip could be part of the frame (as opposed to the planar plate) or the plate may be strong enough (such as by making it thicker) that a lip is not necessary.

Turned-down stiffening lip 100 and turned-up lip 102 are preferably fashioned by casting as integral portions of planar plate 92. Alternatively, one or both could be fashioned as a separate beam and attached to the perimeter of planar plate 92. Peripheral rod 80 serves to strengthen the perimeter of the module by interfacing, and thus sharing, the stress that would otherwise be borne by planar plate 92 alone.

Also shown partially in phantom is a peripheral rod 80. Also shown are two bolt holes 204 and 206 passing through planar plate 92, being configured so as to accept bolts 208 and 210 passing therethrough. It will be appreciated that under many circumstances, it may not be necessary to use bolts 208 and 210 and bolt holes 204 and 206. The fit may be sufficient that gravity will hold the parts in contact with each other.

Pedestal head 202 has an internal axial bore in boss portion 212 which is configured so as to accept the upper portion 250 of pedestal 200. Pedestal head 202 has four equally configured quadrants, separated by slots such as 214 and 216, as shown. Each quadrant comprises an irregularly shaped boss, such as 218, having two flat surfaces, such as 220 and 222 with a groove 224 separating them.

Each irregularly shaped boss has two threaded bores, such as 226 and 228, fashioned therein, which are positioned so as to be axially aligned with the corresponding bolt holes in the flooring members. For instance, threaded bore 228 will be axially aligned with hole 204 in planar plate 92. Threaded bore 226 will likewise be axially aligned with a hole in an adjacent planar plate (not shown), and threaded bore 230, in an adjoining quadrant, will be axially aligned with hole 206 in planar plate 92. Thus, the flooring member 24 is supported by segments of two adjoining quadrants of pedestal head 202.

Likewise, flooring members of adjacent modules will be similarly supported. Note that turned-down stiffening lip 100 will be positioned in grooves 224 and 232, as shown. Also note that peripheral rod 80 will be positioned in slot 216. Also note that boss 212 is shortened such that turned-down stiffening lip 100 can be positioned above it.

Except for the pedestal head, pedestal 200 is of conventional design having a jack screw and an adjusting nut configured so as to provide a leveling means, not described further herein.

The unique design of the pedestal head, as described above, permits the modules to be supported from the bottom of the planar plate, which is substantially the top of the module, rather than from the bottom of a web or grating which is substantially the bottom of the module, as is done with prior art modules. This is very important since it minimizes the overall depth of the module. Furthermore, the load-bearing capability of the module is not limited by the compressive strength of vertically disposed grating members, as with prior art modules.

It is important to note that the pedestal head is but one of the features of the invention that permits adjacent modules to be supported at substantially the top of the module and to interface each other. Other features are the peripheral inclined rods, as described previously; the provision of space outside the perimeter of the base grid 50, configured so as to accommodate the pedestal; the turned-down stiffening lip along the perimeter of the flooring member, as described previously; and the threaded bores in the pedestal head aligned with matching holes in the flooring member, along with bolts, all as described above.

As illustrated in FIG. 13, one of the plates used for controlling the air flow through the flooring system is flooring member 24 in which openings 114 are formed through which the air can pass. A second plate or damper 112 may be positioned immediately below flooring member 24. A plurality of openings 115 are formed within damper 112. Damper 112 can be slid horizontally with respect to flooring member 24 so as to increase the area of overlap of openings 114 (in flooring member 24) and 115 (in damper 112).

Figure 14:
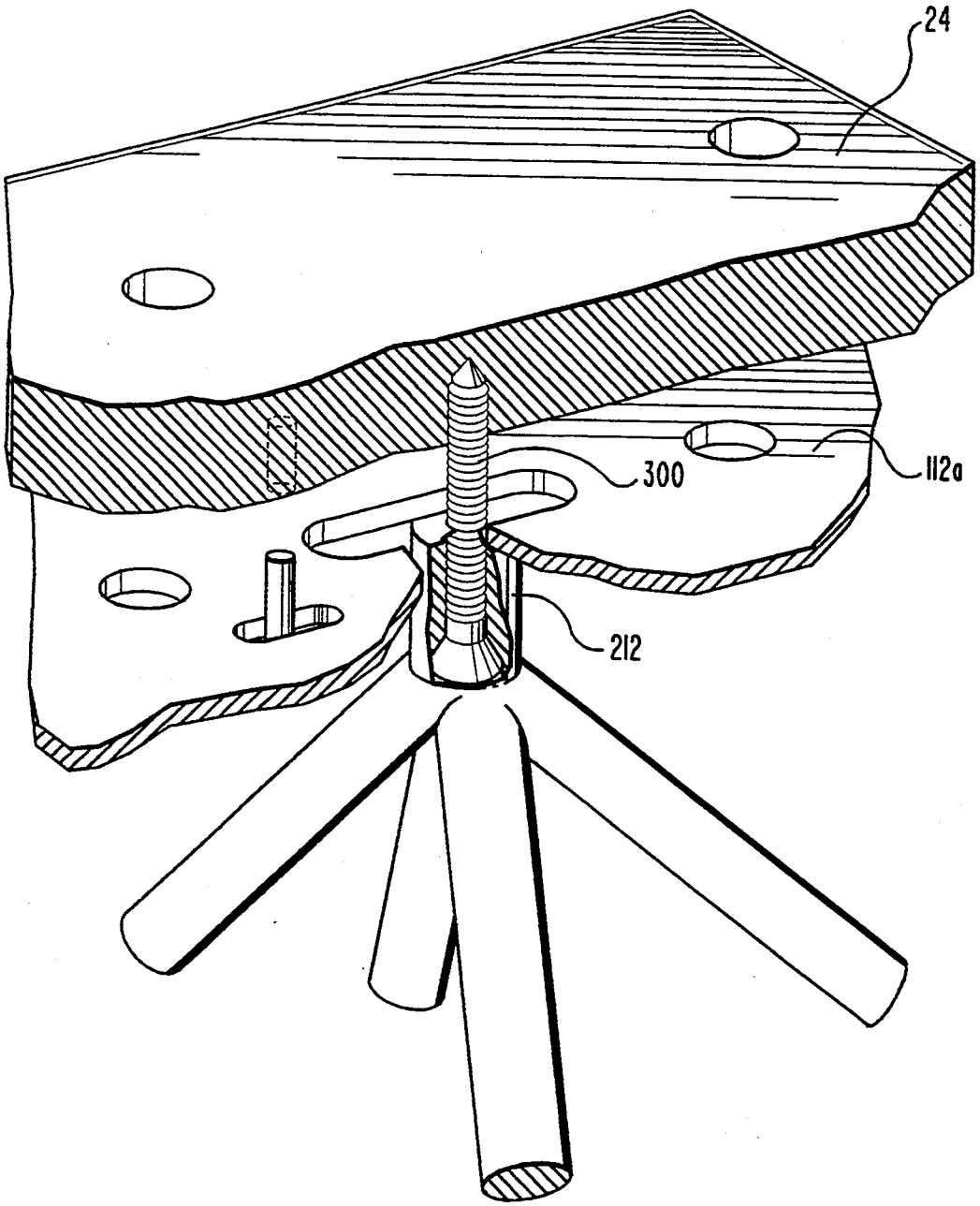
FIG. 14 is a cut-away perspective view of a damper plate and flooring member used in some embodiments of the present invention.
Figure 14A:
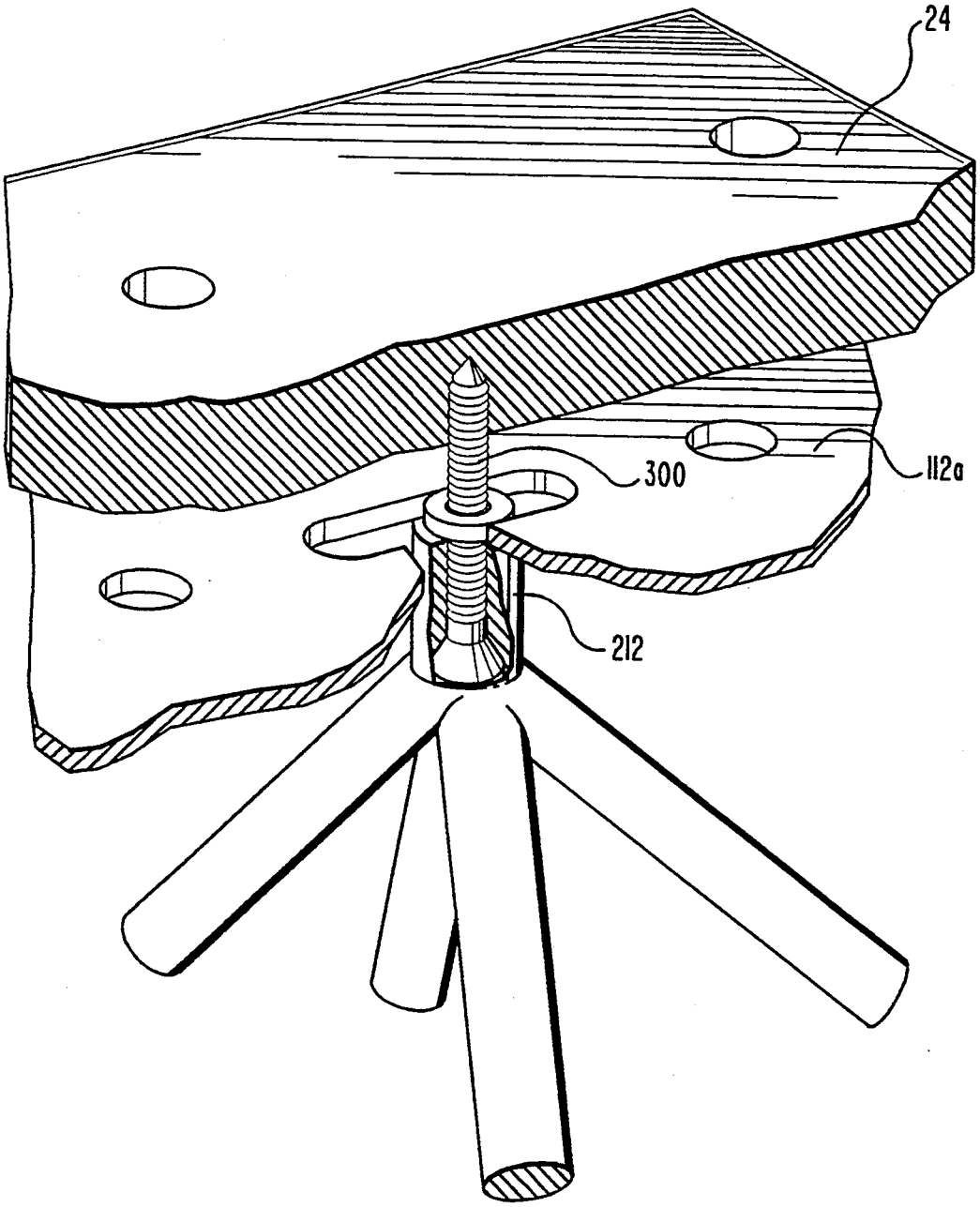
FIG. 14*a* is a cut-away perspective view of a damper plate and flooring member as used in a preferred embodiment of the present invention.

FIG. 14*a* illustrates an alternate damping system for use with a perforated floor member that is attached to the web with screws. A damper 112*a* is located below flooring member 24. Flooring member 24 is attached to the web by screws 300 inserted through the bottom of boss 212. Friction between boss 212 and flooring member 24 may be altered by adjusting the tightness of screws 300. The friction keeps damper 112*a* in close proximity to flooring member 24. A washer may be included to engage slots formed in damper 112*a* as shown in FIG. 14*a*. The washer allows damper 112*a* to slide only along one linear horizontal direction. Thus, the overlap of the holes formed in flooring member 24 and damper 112*a* can be adjusted. The amount of overlap between the holes formed in flooring member 24 and damper 112*a* regulates the amount of air that can flow through the floor.

FIG. 14 shows an alternate method of allowing damper 112*a* to slide only in one linear horizontal direction. In this embodiment, pins are inserted into flooring member 24 in the hole shown in phantom lines. The pins engage narrow slots in damper 112*a*. The damper is thus free to slide only in the direction of the slot. As in FIG. 14*a*, damper 112*a* is held in close proximity to flooring member 24 by friction between flooring member 24 and boss 212. The frictional force can be adjusted by adjusting screw 300 which is inserted through the bottom of boss 212 so as to extend into flooring member 24.

Another, embodiment of the alternate damping system shown in FIGS. 14 and 14*a* utilize two (2) dampers placed contiguous with flooring member 24. Use of two dampers (not shown) may also be employed to allow greater adjustment of the air flow. The upper damper may be affixed to the flooring member while the lower damper is free to move relative to the fixed damper. This system is generally used only when the hole pattern in the flooring member exceeds 40% of the surface area of the flooring member.

According to one aspect of the present invention, a means for securing the flooring member to the web, as detailed in FIG. 8, ans shown again in FIG. 14.

By way of example, and not limitation, the securing means of the present invention may comprise a screw 300 or other known fasteners such as a rivet, a bolt, glue or welding.

Airflow through the floor may then be modulated by manually sliding damper 112*a* relative to flooring member 24 to align or disalign the holes punched in a pattern common to both structures. By increasing or decreasing the flow of air through the flooring members, vertical laminar flow may be achieved.

Finally, although certain specific configurations of the invention have been described in detail in the preceding pages, there are other configurations that are considered to be equivalents, and thus to come within the scope of this invention.

As an example, as noted above, it is preferred that the grid be of planar configuration. However, for some applications a nonplanar configuration could be preferred. This could be the situation wherein a stress analysis revealed the fact that rods substantially centrally located within the module experienced more stress than rods located further out.

In order to conserve material the more peripherally located parts of the web could employ cells having a lesser depth from apex to face than cells more centrally located. This would result in a nonplanar grid.

As another example, the peripheral inclined rods at the corners of the module, such as 80 in FIG. 3, could be eliminated and the pedestal head enlarged so as to support the bottom of the flooring member substantially further inward from the perimeter of the module, thus the pedestal head sharing the stress that would otherwise be experienced by the planar plate 92 instead of peripheral rod 80 at the corner.

Figure 15:
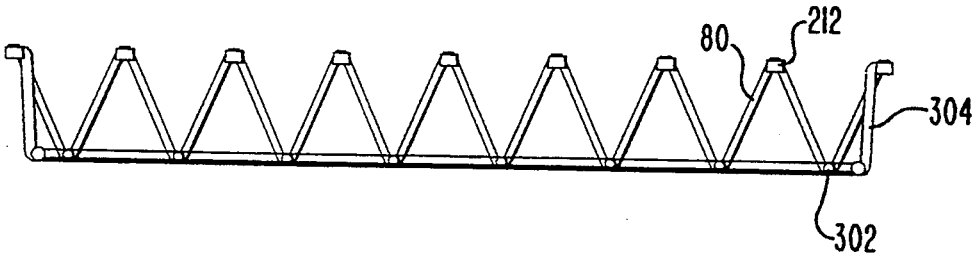
FIG. 15 is a cross sectional view of a web having vertical edge rods.

Although certain advantages can be derived from supporting the space frame web at or near the flooring member, it is also advantageous in certain circumstances to support the space frame web underneath the grid thereof. The space frame web utilized in such a system is illustrated in FIG. 15. Supporting the space frame web from the bottom, however, does present problems different from those encountered by supporting the space frame web near the top.

For example, an elongated grid 302 must extend nearer to the edge of the flooring member so that the edges of the space frame web will be supported. As elongated grid 302 is extended, it also becomes necessary, or at least desirable, to support the edges of the flooring member by using a vertical support member 304 near the edges of the space frame web. As can be seen in FIG. 15, use of the vertical support member 304 and elongated grid 302 allows adjacent modules to be positioned so that adjacent grids are nearer each other. This allows for a pedestal to support several modules simultaneously without requiring a head on the pedestal that is unduly large.

Figure 16:
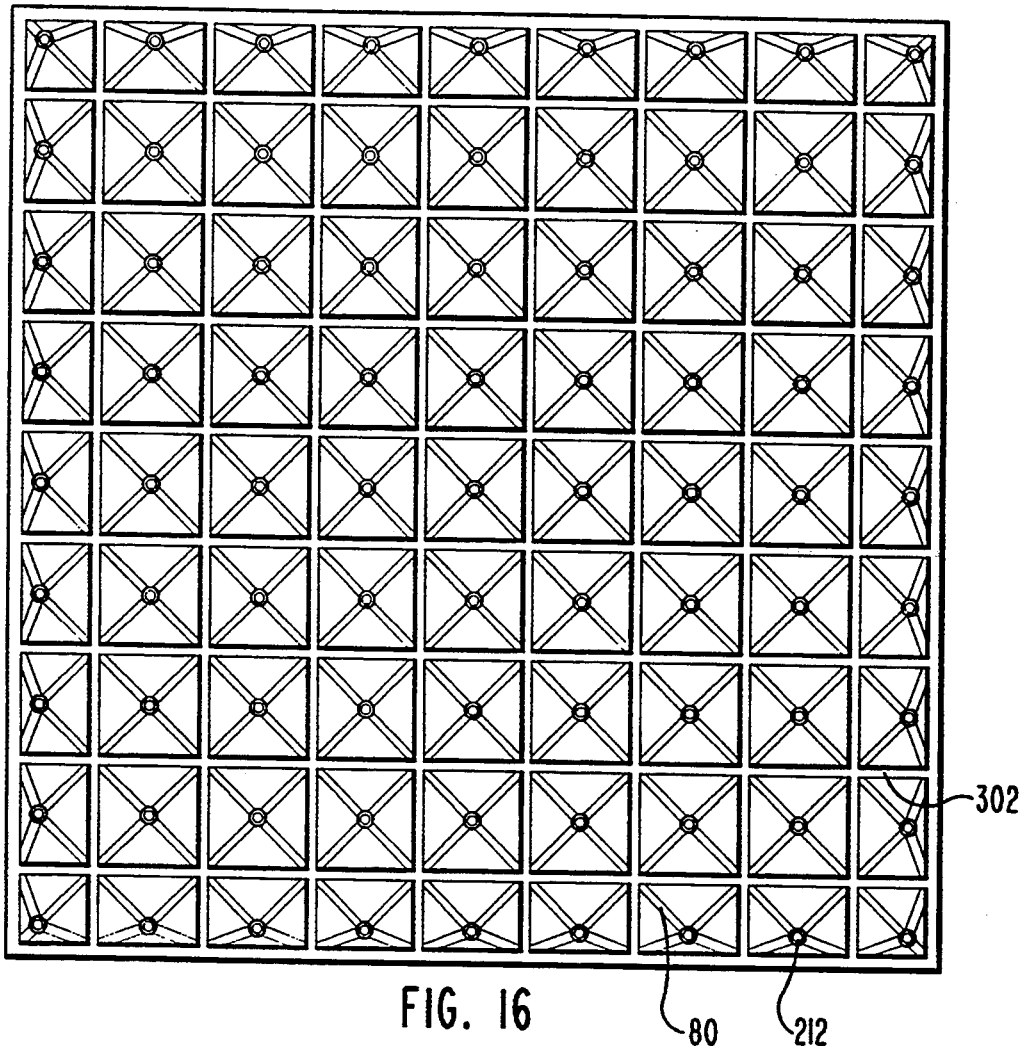
FIG. 16 is a plan view of an alternate embodiment of the web of the present invention.

FIG. 16 is a plan view of an alternate space frame web. As can be seen in FIG. 16, loads placed upon a flooring member overlaying the space frame web are transferred through posts 212 elongate structural members 80 to the grid 302.

When electrical boxes must be placed within the space frame web, some of the elongate structural members 80 must be broken off to facilitate placement of the electrical box. Removal of some of the elongate structural members 80 results in additional forces being carried by adjacent elongate structural members. These additional forces, however, because of the nature of the space frame web, disperse along the grid 302 resulting in no significant reduction in the load bearing capacity of the space frame web.

In addition, one advantage afforded by the space frame web construction, is that in webs using a thickness or depth of over 2 inches, the grid may remain with only the removal of the elongate structural members 80 required for placement of an electrical box having a depth of less than 2 inches. In this situation, the load bearing capacity of the space frame web is diminished even less as the side walls of the electrical box when attached to the space frame web provide an almost equal amount of load transfer as was provided by the removed elongate structural members.

Figure 17:
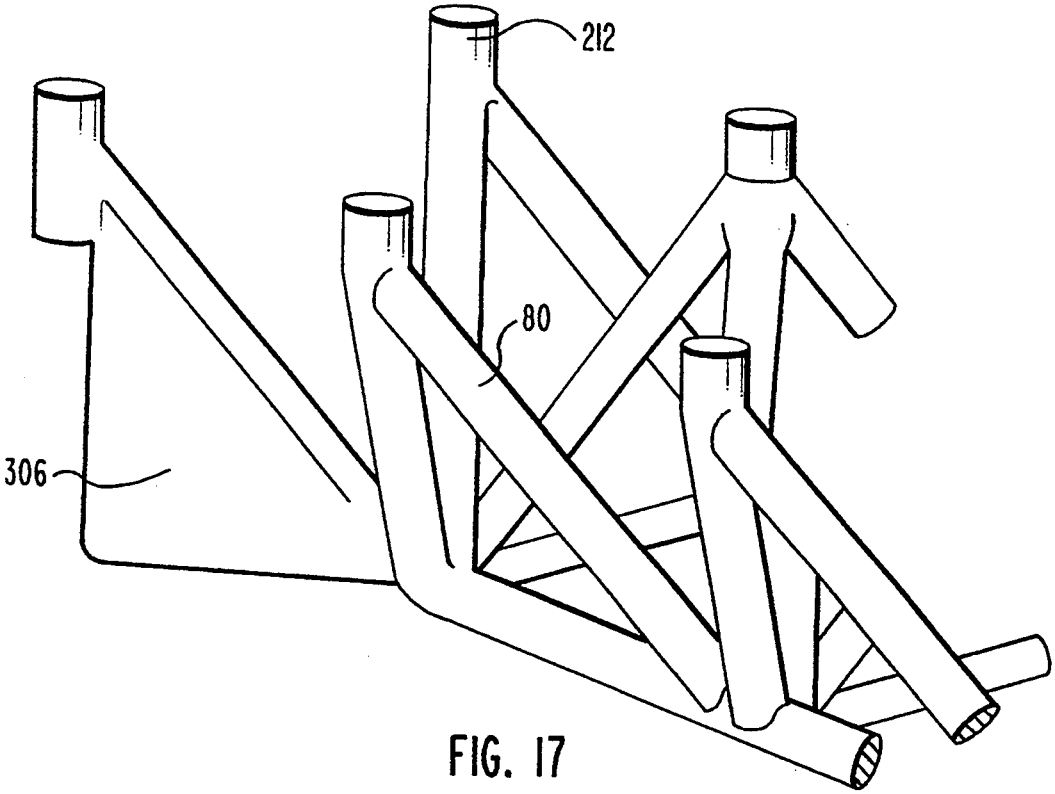
FIG. 17 is an enlarged view of a corner of an embodiment of the web of the present invention.

In addition to extending the grid 302 nearer to the corners of the space frame web to facilitate support from the bottom of the web, structures may be integrated within the web itself to facilitate support from the bottom of the web. Such a structure is illustrated in FIG. 17, wherein the web contains a corner gusset 306 which is formed integral with elongate structural member 80 and the base grid to transfer loads placed on the post located in the corner of the space frame web down through the corner gusset 306 into a pedestal placed under the corner gusset.

Figure 18:
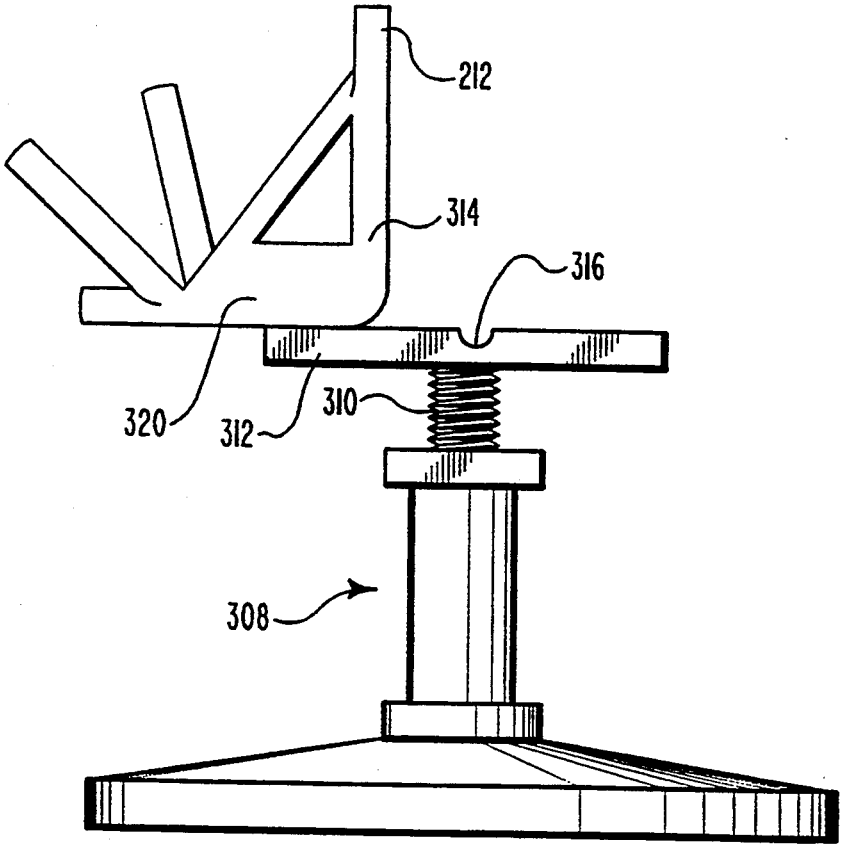
FIG. 18 is an enlarged view of an alternate version of corner, used in a web and supported by a pedestal.

It will be appreciated that this structure may also be used when the space frame web is supported near the top of the web or underneath post 212. Another preferred embodiment of the corner gusset 306-type structure is illustrated in FIG. 18, wherein the corner is shown positioned on a pedestal. Pedestal 308 employs a head 310 having a substantially flat support plate 312. Corner gusset 314 illustrated in FIG. 18 may employ a concave groove 316 to assist in retaining the corner gusset within the top plate.

According to one aspect of the present invention, means for maintaining the flooring system at a preselected height above the subfloor are provided.

By way of example and not limitation, the means for maintaining the flooring system at a pre-selected height above the subfloor in the preferred embodiment illustrated in FIG. 18 comprise pedestal 308 and the bottom chord of corner gusset 314.

As discussed earlier, differing load bearing capacities may be achieved for each module of the flooring system. The load bearing capacity may be varied by applying a flooring member having a greater thickness than adjacent flooring members. Application of a flooring member having a greater thickness, however, would result in a module having a greater overall height above the subfloor than adjacent modules. To remedy this, a bottom chord 320 is thickened in corner gusset 314 so that a portion of bottom chord 320 may be milled away equal to the increased height of the thicker flooring member. As a result, the four (4) intersecting modules that share each pedestal support plate may each have different overall heights when measured from the top of the flooring member to the bottom of the grid, and yet may still have the same overall height when measured from the subfloor.

Figure 19:
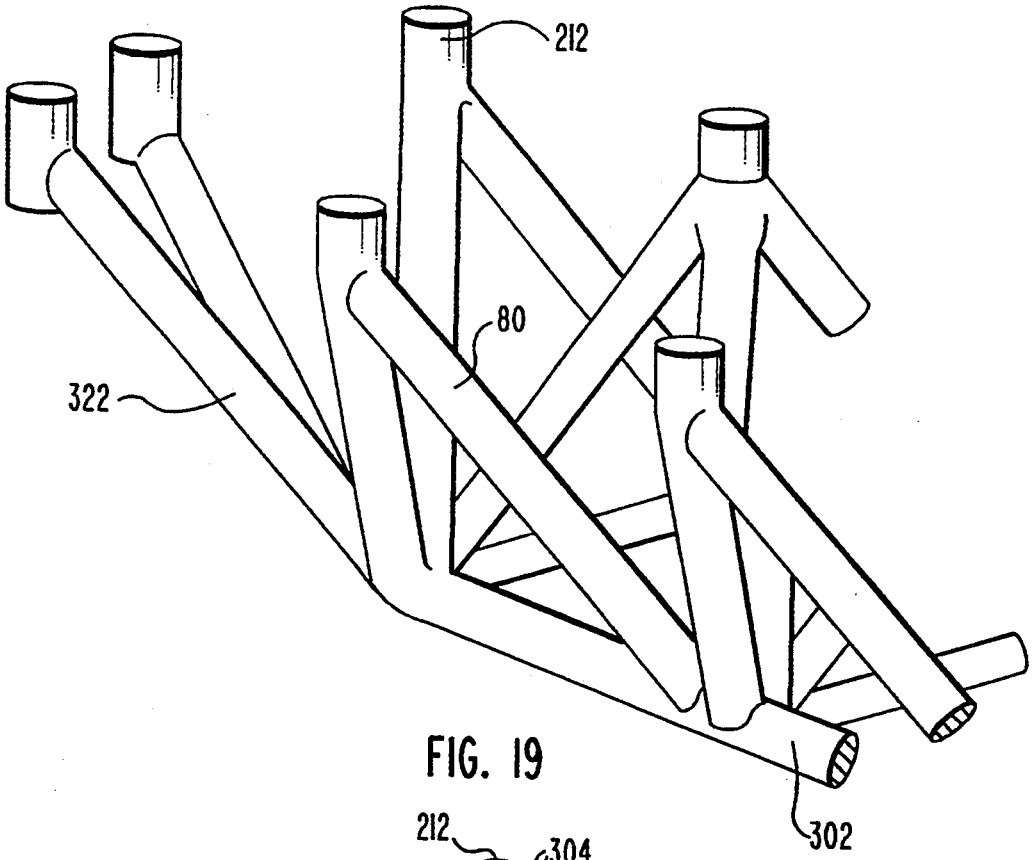
FIG. 19 is an enlarged view of an alternate version of the corner shown in FIG. 17.

Another embodiment of the present invention is illustrated in FIG. 19 which provides for either bottom or top support of the space frame web. Top support is facilitated by employing a Y-shaped corner member 322 which provides two posts which are capable of resting upon the support plate of a pedestal. In addition, the bottom of grid 302 may be supported at the intersection of Y-shaped corner member 322 and the grid.

Figure 20:
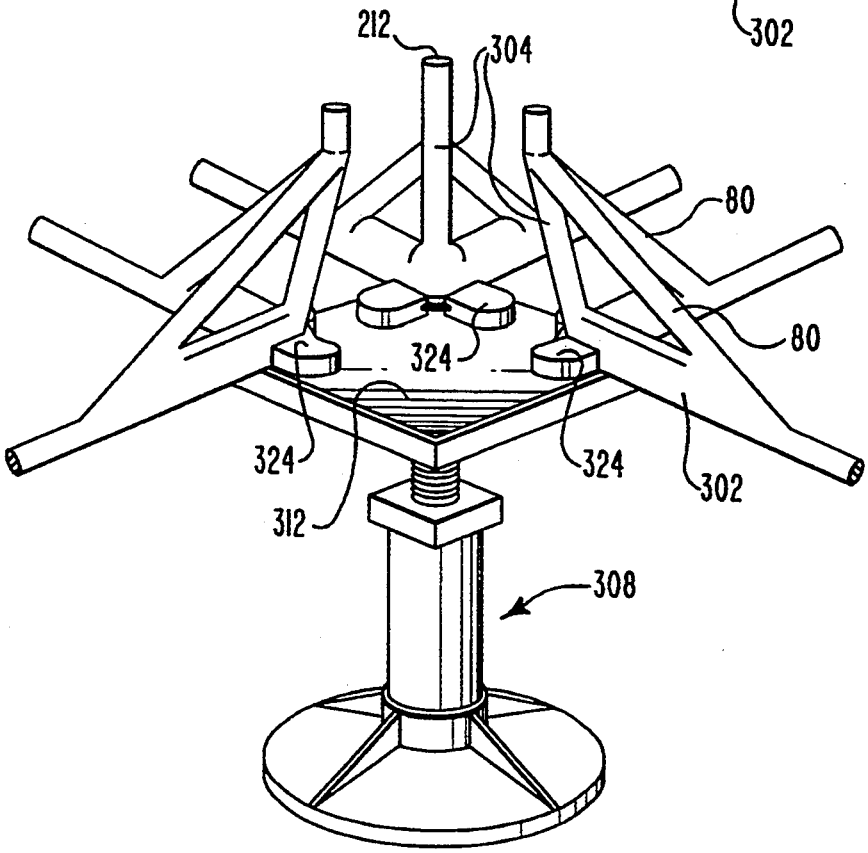
FIG. 20 is a perspective view of another alternate version of the corners shown in FIG. 17.

One final embodiment of the present invention is illustrated in FIG. 20. FIG. 20 illustrates pedestal 308 having an essentially flat support plate 312 supporting the corners of two adjacent space frame webs. Formed as a part of the corner of the space frame web are support discs 324 formed integrally with grid 302. Support discs 324 accord more surface area to the corner of the space frame web which is supported by pedestal 308. This provides for a more stable placement of the corner of the space frame web, thereby increasing the moment of inertia necessary to tip the space frame web.

The added support discs also facilitate the transfer of loads transmitted by vertical support member 34 located at the corner of the space frame web.

In addition, a slight outward angle utilized for the substantially vertical support member 304 allows an automated screwing machine to screw the flooring member to the boss.

Although supporting the space frame web from the bottom may increase the overall space required between the subfloor and the flooring member, it must be understood that unlike prior art flooring systems, air may flow directly through the space frame web. As a result, the approximately 2 inches displaced by the space frame web must be included in any air flow calculations in contradistinction to the prior art where the flooring system was required to be deducted from the space allotted for air flow.

For example, in a situation wherein it has been calculated that the space required for sufficient air flow beneath the flooring members requires a space of 12 inches, prior art systems, despite being supported from beneath the flooring members themselves, nevertheless require 12 inches between the bottom of the flooring system arid an overall height of 14 inches between the flooring member and the subfloor.

When utilizing the space frame web of the present invention, however, an air space of 12 inches can be provided by utilizing a pedestal having a height of 10 inches plus the 2 inches of air space provided within the space frame web for an overall height of 12 inches between the bottom of the flooring member and the subfloor despite having the space frame web supported from the bottom. This results in a savings of 2 inches of usable space in the room above such a flooring system.

Strengthening the flooring member by the web and grid of the space frame structure results in a lighter, and thus more easily removable and interchangeable module. Likewise the cost is reduced.

The use of the flooring module also results in a module wherein the stress is largely absorbed by the web and the grid, greatly reducing the stress in the flooring member. Thus, access ports can be fashioned in the flooring member without cutting through the web and grid configuration of the space frame structure, thereby resulting in much less impairment of the load-bearing capability than in prior art designs. Furthermore, since the flooring member is separately fashioned, such access ports can be fashioned by punching rather than sawing.

The use of the space frame structure also results in a design wherein different modules may incorporate webs and grids having differing structural strengths, thus resulting in differing load-bearing capabilities without the necessity of modifying the thickness of the flooring member. Thus sections of the floor can be configured so as to have greater load-bearing capabilities than other sections without changing the floor level.

The use of a configuration wherein the module is supported at the bottom of the thin flooring member also results in the module having a depth only slightly greater than the required access space between the floor and the subfloor.

As a further feature, flooring members of increased thickness can be employed by simply providing deeper receptors for the posts of the grid to interface, or by pressing the posts further into the receptors.

The use of a flooring member having perforations therein also permits air flow to occur between the space above the floor and the space below the floor, such as is preferred for clean rooms and computer rooms. Furthermore, since the flooring member is separately fabricated, such perforations can be punched rather than drilled.

The unique design of the unit also provides means for interfacing and interconnecting adjacent modules wherein the supporting pedestals interface the underneath side of the flooring member and also provides leveling means.

The configuration, being symmetrical, also provides means whereby the space frame structure can be easily removed, reconfigured, and replaced in the same or a different orientation than it had originally.

And lastly the module has provisions whereby it may be used to replace aluminum flooring, steel flooring, concrete flooring, and steel-encased wood core flooring.

Thus all the objectives have been achieved.

The present invention may be embodied in other specific forms and for other specific uses without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A modular raised access flooring system comprising:

(a) a plurality of flooring modules capable of independent load bearing, each flooring module comprising;

(i) substantially planar grid;

(ii) a plurality of elongate structural members formed integrally with the grid and extending upward from the grid, the grid and accompanying elongate structural members forming a space frame web; and (iii) a flooring member affixed to the web; and means for maintaining and supporting each flooring module above a subfloor.

2. A raised access flooring system as recited in claim 1, wherein the grid of each flooring module comprises a plurality of horizontally disposed, interconnected elongate structural members.

3. A raised access flooring system as defined in claim 1, wherein each plurality of elongate structural members and each grid comprise a unitary casting.

4. A raised access flooring system as defined in claim wherein the elongate structural members are configured as rods.

5. A raised access flooring system as defined in claim 1, wherein each space frame web is configured such that it may be emplaced in at least two different orientations with respect to adjacent space frame webs.

6. A raised access flooring system as recited in claim 1, wherein the space frame web of each flooring module comprises a multiplicity of interfacing and interconnected pyramidal cells formed by the elongate structural members, each of the cells having a base, three or more triangular faces, three or more vertexes, and an apex, the cells being arranged in a repetitive, space-filling fashion, avoiding intercellular spaces between the bases of adjacent cells, and further wherein the apexes have a substantially planar relationship with each other.

7. A raised access flooring system as defined in claim 6, wherein each flooring module further comprises means for engaging at least some of the apexes of the pyramidal cells to the flooring member, said means comprising a post integral with the apex of the pyramidal cell, the post being positioned so as to be substantially orthogonal to the flooring member, and configured to be capable of engaging means for securing the flooring member to the post.

8. A raised access flooring system as recited in claim 1, further comprising means for maintaining the flooring system at a preselected height above a subfloor.

9. A raised access flooring system as recited in claim 8, wherein the means for maintaining the flooring system at a preselected height comprises a pedestal in contact with a grid of a space frame web.

10. A raised access flooring system comprising a removable and interchangeable flooring module configured so as to interface adjacent modules, the flooring system comprising:

(a) a plurality of elongate structural members;

(b) a horizontally disposed grid which, together with the plurality of elongate structural members, forms a space frame web for supporting loads; and (c) a flooring member so sized and configured so as to engage and substantially cover the space frame web which is comprised of the grid and plurality of elongate structural members; and (d) a means for maintaining and supporting the flooring module above a subfloor.

11. A raised access flooring system as recited in claim 10, wherein the flooring member has formed within it holes passing therethrough.

12. A raised access flooring system as recited in claim 10, wherein the flooring member is comprised of successive layers of aluminum and vinyl.

13. A raised access flooring system as recited in claim 10, wherein the flooring member is interchangeable and wherein adjacent flooring members may be comprised of different materials.

* * * * *

UNITED STATES PATENT AND TRADEMARK OFFICE

CERTIFICATE OF CORRECTION

PATENT NO. : 5,412,914
DATED : May 9, 1995
INVENTOR(S) : TERRY L. DAW et al.

It is certified that error appears in the above-indentified patent and that said Letters Patent is hereby corrected as shown below:

Title page, column 1, item [76], line 2, "84017" should be --84107--

Title page, column 2, "Other Publications," line 9, "Evoluation" should be --Evolution--

Column 2, line 8, "For clean" should be --Clean--

Column 6, line 48, "modules is" should be --modules are--

Column 6, line 57, "On such strengthening strategy" should be --One such strengthening strategy--

Column 7, lines 56-57, "of corner," should be --of the corner--

Column 11, line 60, "preferably," should be --Preferably,--

Column 14, line 39, "Another," should be --Another--

Column 14, line 40, "utilize" should be --utilizes--

Column 14, line 50, "web, as" should be --web is--

Column 14, line 51, "ans shown again in FIG. 14." should be --and shown again in FIG. 14.--

Column 14, line 65, delete "to" (2nd occurrence).

Column 15, line 15, "the pedestal head sharing the stress" should be --the pedestal head would share the stress--

Column 17, line 19, "arid" should be --and--

UNITED STATES PATENT AND TRADEMARK OFFICE

CERTIFICATE OF CORRECTION

PATENT NO. : 5,412,914

DATED : May 9, 1995

INVENTOR(S) : TERRY L. DAW et al

It is certified that error appears in the above-indentified patent and that said Letters Patent is hereby corrected as shown below:

Column 18, line 48, "in claim" should be --in claim 1,--.

Signed and Sealed this

Seventeenth Day of October, 1995

*Attest:*

Bruce Lehman

BRUCE LEHMAN

*Attesting Officer*

*Commissioner of Patents and Trademarks*